US005554062A

United States Patent [19]

Goldsen

[11] Patent Number: 5,554,062

[45] Date of Patent: Sep. 10, 1996

[54] BUILDING WORD BLOCKS

[76] Inventor: Esther Goldsen, 27 Spruce Hill Rd., Weston, Conn. 06883

[21] Appl. No.: 449,801

[22] Filed: May 24, 1995

[51] Int. Cl.[6] ..... A63H 33/08

[52] U.S. Cl. ..... 446/124; 446/125; 434/171; 434/172

[58] Field of Search ..... 446/85, 124, 125, 446/117; 434/171–175

[56] References Cited

U.S. PATENT DOCUMENTS

| | | | |
|---|---|---|---|
| 176,144 | 4/1876 | McDougall | 446/125 |
| 319,764 | 6/1885 | Westcott | 446/125 |
| 2,911,818 | 11/1959 | Smith | 446/125 |
| 2,981,009 | 4/1961 | Lindquist | 446/117 |
| 3,611,621 | 10/1971 | Folson | 446/124 |
| 4,003,144 | 1/1977 | Maddestra . | |
| 4,334,868 | 6/1982 | Levinrad | 434/172 |
| 4,698,023 | 10/1987 | Marino | 446/125 |
| 5,000,713 | 3/1991 | Cheng . | |
| 5,306,198 | 4/1994 | Forman . | |
| 5,354,224 | 10/1994 | Ishiyama | 446/85 |
| 5,417,604 | 5/1995 | Rafelman | 446/124 |

FOREIGN PATENT DOCUMENTS

| | | | |
|---|---|---|---|
| 649295 | 7/1992 | Australia | 446/124 |
| 379389 | 7/1990 | European Pat. Off. | 446/125 |
| 2568669 | 2/1986 | France | 446/124 |
| 23438 | 2/1977 | Japan | 446/126 |

*Primary Examiner*—Robert A. Hafer
*Assistant Examiner*—Jeffrey D. Carlson

[57] ABSTRACT

A toy educational building block set having alphabetical and other indicia for word building. The building blocks are adapted to have letter units selectively secured to their surfaces to form alphabetical blocks.

2 Claims, 2 Drawing Sheets

BUILDING WORD BLOCKS

BACKGROUND OF THE INVENTION

1. Field of the Invention

The present invention relates to toy building blocks of an educational nature and in particular building blocks having alphabetical and other indicia thereon for educational exercises and word games.

Alphabetical blocks have long been a part of children's play and education and there continue to be many kinds of alphabet blocks available. These blocks take various sizes, shapes, designs and may be made of different materials. Also, there are numerous children's building blocks that do not contain letters of the alphabet or other intelligence indicia. The field of the present invention is that of adding greater flexibility to building blocks to enhance their educational use in word building and other exercises.

2. Description of the Prior Art

Traditional building blocks come in cubes each of which has a letter of the alphabet displayed on one or more of its sides and these letters are fixed in place on the blocks.

In addition to the traditional alphabet blocks, there are currently other kinds of highly manipulative building blocks that interlock with each other to form block structures of various types. For many years they have been used for manipulative play and, in education for teaching, counting, measuring and other mathematical concepts rather than word building.

Because these latter blocks have no letter of the alphabet or indicia they have no capability for use in word building. Furthermore, the ordinary and customary method of creating alphabet blocks, i.e., imprinting a letter of the alphabet on one or more sides of the block is problematic when applied to these non-alphabet blocks because of their attachment points. Since there are no blank sides on which to place the letters, the attachment points on the different sides of the blocks interfere with the letter of the alphabet graphics. Another problem is presented by the need to change the orientations of the letters so that they appear upright when the blocks are connected in different directions.

An example of prior art word and alphabet games is U.S. Pat. No. 3,077,677 which provides a board having recesses adapted to receive alphabet pieces each of which has a peg projection to be received in the board recesses. In this way words may be constructed and word games engaged in.

U.S. Pat. No. 3,139,698 shows a set of building blocks of the type that lack letters of the alphabet but which can be attached one to another in various combinations to produce structures or figures. British Patent No. 11,304 discloses another type of board arrangement in which letter blocks with projections can be received by the pegboard to produce words and word games.

SUMMARY OF THE INVENTION

The present invention provides a system of blocks in which individual blocks that do not have letters of the alphabet thereon are converted to alphabet blocks. This is effected by having separate letter units that may be individually applied to the basic block units.

The letter units may be secured to the blocks in various ways as by equipping the letter units with pegs that are received in recesses in the faces of the blocks. The block recesses may be in a plurality of block faces and in the case of cubes there may be five faces having recesses to selectively receive the pegged letter units.

In this manner, when the blocks are strung together to form linear sections, words may be formed. The blocks may be secured together by pegs and recesses so that they may be assembled in three-dimensional space and accordingly words and word games may be engaged in three-dimensions.

The underlying block to which the letter units are applied may take various forms such as a cube, prism, or larger structure as will be described hereinafter.

Against the foregoing background it is a primary object of the present invention to provide alphabet units comprising a block that is adapted to receive letter units to permit formation of words and word games.

It is a further object of the present invention to provide blocks that may be assembled into linear sections and which individually are adapted to receive letter units and in which the linear sections may be joined in three-dimensional space to provide an assembly of words in three dimensions.

It is a further object of the present invention to provide blocks with separately connectable indicea units to permit important word building capability, without changing the basic form and function of the blocks thereby giving them added value as a language teaching tool, without diminishing their original value as a math teaching aid, making them doubly useful.

It is a still further object of the present invention to provide a word building block system in which the basic block may be a sphere or polyhedron adapted to receive letter units or other blocks to which letter units are attached.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DETAILED DESCRIPTION OF THE INVENTION

Figure 1:
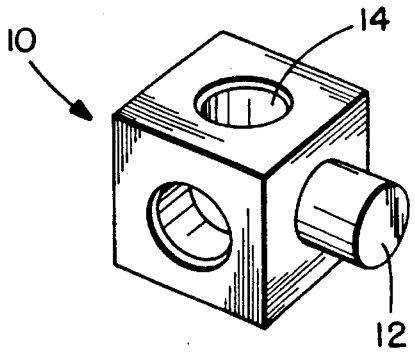
FIG. 1 is a perspective view of a cube building block of prior art construction.
Figure 2:
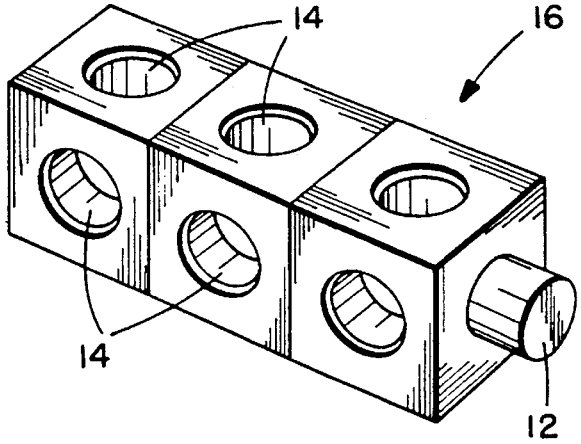
FIG. 2 is a perspective view of an assemblage of building blocks that form a linear section.

Referring now to FIGS. 1 and 2, Numeral 10 indicates a building block or block unit of known construction. The unit is in the configuration of a cube having a projection or peg 12 on one face and openings or recesses 14 on the other five faces. In this manner the blocks 10 may be assembled together to form a linear section 16 as illustrated in FIG. 2. These types of blocks are well known, commercially available, and are formed in different configurations as prisms as well as cubes. They are made of various materials, generally of plastic. The pegs 12 fit snuggly into the recesses 14 so that when a linear section is assembled it will hold together.

Figure 3:
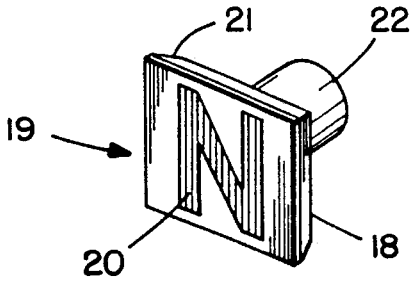
FIG. 3 is a perspective view of a letter unit of the present invention.
Figure 4:
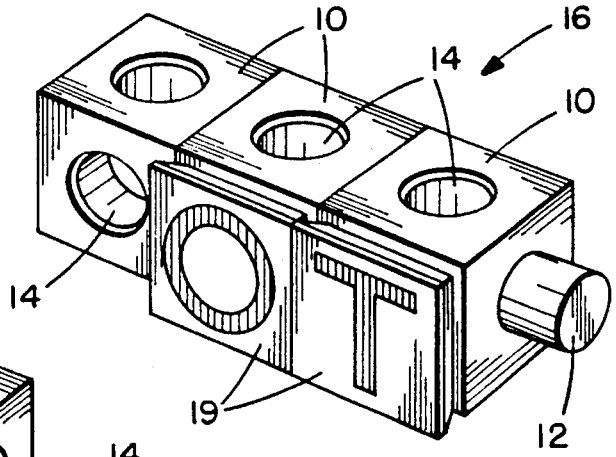
FIG. 4 is a perspective view of a linear section of blocks having letter units of the present invention.
Figure 5:
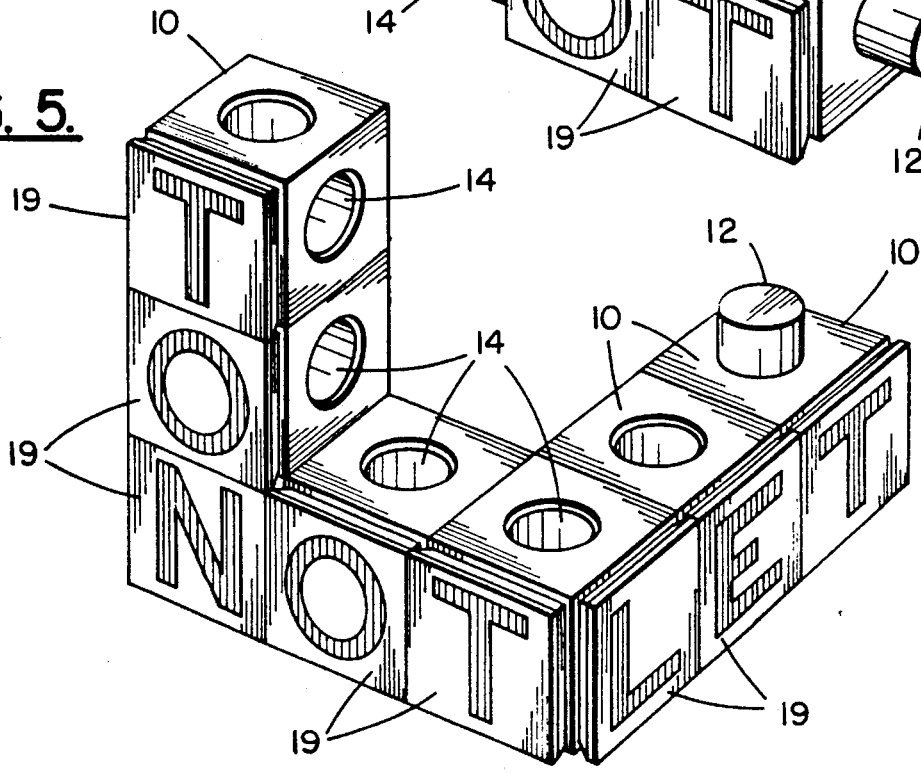
FIG. 5 is a perspective view of blocks having letter units applied thereto extending in three-dimensions.

Blocks of the above described construction can be manipulated and various configurations can be built through appropriate assemblage. However, a limitation of these blocks is that they do not carry letters or other intelligence indicia. Because of the peg or recesses in the various faces and because the blocks can be turned and connected in different directions, it would be difficult and impractical to directly apply letters to the block faces. Applicant has devised a system to overcome this disadvantage and has designed a letter unit 19 as illustrated in FIG. 3. The unit includes a flat member 18 having an outer surface upon which a letter such as 20 is imprinted. A peg or projection 22 extends from the opposite face of member 18 and is somewhat similar to the pegs 12 of the block units. The inner edges of member 18 are beveled as at 21 for ease of handling. Thus the letter unit peg 22 may be inserted in a selected face of a block to in effect equip the block with a letter. This is illustrated in FIG. 4 wherein three blocks 10 are secured together by pegs received in recesses and letter units 19 are applied to appropriate faces of blocks 10. It is seen then that the letter units may be applied selectively at any desired face or number of faces of a block unit 10. In addition the letter units may be rotated for appropriate orientation to spell out words and engage in word games. This is illustrated in FIG. 5 where the letter T has been rotated to form a vertical word as distinguished from the horizontal orientation of FIG. 4. Further, FIG. 5 illustrates the three-dimensional facility of the assembled blocks and letter units.

Figure 6:
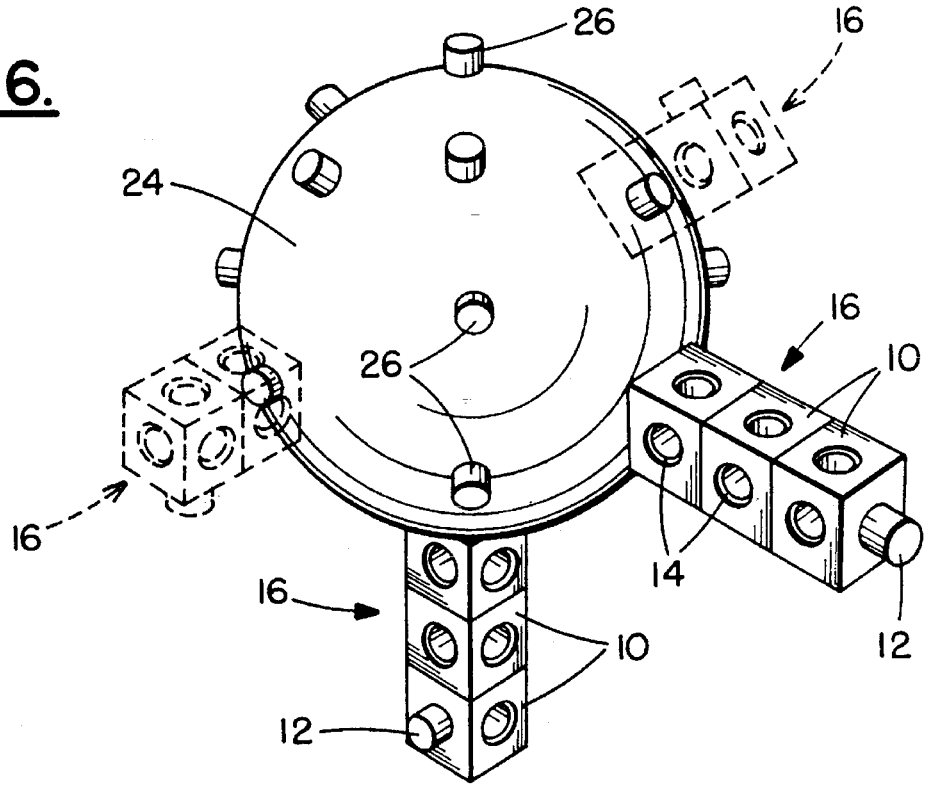
FIG. 6 is a perspective view of a sphere to which individual blocks and linear sections of blocks may be applied.

FIG. 6 illustrates another embodiment of the invention in which there is provided a support unit or element comprising a sphere 24 having pegs 26 positioned at various locations about its surface. The pegs 26 are of the diameter of pegs 12 of blocks 10 and thus individual or linear sections of the blocks may be secured to sphere 24. In FIG. 6 there are four linear sections 16 of blocks shown extending from this sphere.

It should be understood that sphere 24 could equally well be a polyhedron of any convenient number of faces and in place of the pegs 26 this sphere 24 or polyhedron could well have recesses that would receive the pegs 12 of the block units 16. The linear sections of blocks would of course receive letter units in any desired sequence in accordance with the words or word games being engaged in. Alternatively a sphere or polyhedron support unit having recesses could receive individual letter units. The peg of a letter unit would be conveniently received in the recess of the support unit.

Figure 7:
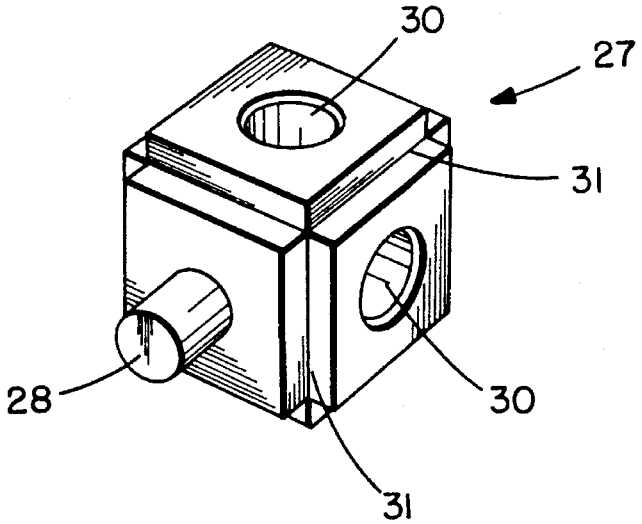
FIG. 7 is a perspective view of an improved block of the present invention.

FIG. 7 illustrates an improved block unit. It is seen that the blocks above described are cubes that are manipulated and assembled together. The improved block 27 shown in FIG. 7 is similarly of cube configuration and includes a peg 28 on one face and recesses 30 on the other faces. However, the improved block has faces that are somewhat raised to provide angular channels 31 along each of the cube edges. It has been found that a block of this construction is more readily and conveniently manipulated to receive, rotate and remove the letter units by providing more space between the letter unit and the block unit.

Having thus described the invention with particular reference to the preferred forms thereof, it will be obvious that various changes and modifications may be made therein without departing from the spirit and scope of the invention as defined in the appended claim.

What is claimed is:

1. An educational alphabet and word toy comprising: a combination of interlocking blocks and removable letter units with means for gripping;

each block having the general configuration of a cube having six faces;

each cube having a circular recess on five faces thereof and a cylindrical peg on one face of a diameter substantially equal to the recesses;

each letter unit including a substantially flat face with a letter indicia thereon;

a cylindrical peg projecting from each letter unit opposite the flat face thereof and of a diameter substantially equal to the diameter of the circular recesses in said cubes;

said letter units being no larger than the faces of said blocks;

a beveled outer edge around the periphery of each letter unit, defining said means for gripping by providing a separation between said beveled edge and a face of a cube when said letter unit is secured to said face.

2. An alphabet block comprising:

a cube having six faces;

a square raised surface centered on each said cube face forming channels along the edges of the cube;

a circular opening extending through five of said square raised surfaces;

each cube having a circular recess on the five sides corresponding to and aligned with the five circular openings in the five square raised surfaces;

a cylindrical peg extending from one side of a square raised surfaces and having a diameter substantially equal to said circular openings and said circular recesses.

* * * * *